US005791989A

United States Patent [19]

Slinkman

[11] Patent Number: 5,791,989

[45] Date of Patent: Aug. 11, 1998

[54] METHOD OF PLAYING A BLACKJACK GAME WITH A MODIFIED BETTING ARRANGEMENT

[76] Inventor: J. F. R. Slinkman, 1511 Old Compton Rd., Richmond, Va. 23233

[21] Appl. No.: 781,794

[22] Filed: Jan. 10, 1997

[51] Int. Cl.[6] ..... A63F 1/00

[52] U.S. Cl. ..... 463/12; 273/292; 273/274

[58] Field of Search ..... 273/292, 274, 273/309; 463/12, 13

[56] References Cited

U.S. PATENT DOCUMENTS

| | | | |
|---|---|---|---|
| 4,995,615 | 2/1991 | Cheng | 273/292 |
| 5,100,137 | 3/1992 | Fulton | 463/13 |
| 5,141,234 | 8/1992 | Boylan et al. | 273/306 |
| 5,174,579 | 12/1992 | Griffiths | 273/292 |
| 5,257,810 | 11/1993 | Schorr et al. | 273/292 |
| 5,275,400 | 1/1994 | Weingardt et al. | 463/12 |
| 5,277,424 | 1/1994 | Wilms | 463/12 |
| 5,280,915 | 1/1994 | Groussman | 273/292 |
| 5,294,128 | 3/1994 | Marquez | 273/292 |
| 5,320,356 | 6/1994 | Cauda | 273/292 |
| 5,356,140 | 10/1994 | Dabrowski et al. | 463/12 |
| 5,377,973 | 1/1995 | Jones et al. | 273/292 |
| 5,377,993 | 1/1995 | Josephs | 273/292 |
| 5,390,934 | 2/1995 | Grassa | 273/292 |
| 5,393,067 | 2/1995 | Paulsen et al. | 273/292 |
| 5,454,570 | 10/1995 | Karal | 273/292 |
| 5,632,485 | 5/1997 | Woodland et al. | 273/292 |

*Primary Examiner*—Benjamin H. Layno
*Attorney, Agent, or Firm*—Hoffman, Wasson & Gitler, PC

[57] ABSTRACT

A conventional Twenty-One game is modified to include a second wager or HEDGE BET™ which is made by the player before any cards are dealt. The player wins the HEDGE BET™ if the dealer's first two cards are a standing hand. After making the HEDGE BET™, the Twenty-One game is played out according to conventional rules of play and the normal winning and losing hands are paid or collected by the dealer. The dealer also reconciles the HEDGE BET™ based on whether the dealer has achieved a standing hand. This additional wager is attractive to players since it affords a further opportunity to bet on each hand and to win if the dealer achieves a standing hand, in which the odds appear to favor the player due to a wide range of two card combinations that will result in the dealer's standing hand. The player's odds of winning the HEDGE BET™ can be slightly reduced in favor of the Casino without creating the perception of unfair advantage by, for example, excluding a soft 17 as a winning hand, and by automatically converting the HEDGE BET™ to an insurance bet if the dealer's face card is an Ace or a 10.

21 Claims, 2 Drawing Sheets

METHOD OF PLAYING A BLACKJACK GAME WITH A MODIFIED BETTING ARRANGEMENT

TECHNICAL FIELD

The present invention relates generally to a modified game of Blackjack or Twenty One and, more particularly, to a modification in which the player is permitted an additional wager with respect to whether the dealer achieves a standing hand with the dealer's first two cards.

BACKGROUND ART

The game "Twenty-One", also known as "Blackjack" is a very popular game played in casinos and other types of gaming establishments. The objective is for the player to attempt to obtain a hand card count of 21 or a hand count as close to 21 as possible without exceeding 21. In each round of the game, the player plays only against the dealer and the winning hand is the one closer to 21; however, if the count of the player's hand goes over 21 then the player loses regardless of the final count of the dealer's hand.

One or more standard decks of playing cards are used wherein each card counts its face value, except face cards which have a value of 10 and Aces which have a value of 1 or 11 as determined to the count of the hand by the player. Both the dealer and the player(s) initially receive two cards. Usually the dealer's first card is dealt face up and his second card dealt face down. The player will draw additional cards if necessary in order to try and beat the count of the dealer's hand. If the player's count exceeds 21, the player 'busts'. After all of the players have taken additional cards or have stood on their hand, the dealer then 'stands' or 'hits' based on pre-established rules of the game discussed more fully below. Typically, however, if the dealer has less than 17, the dealer must take another card (i.e. 'hit'). If the dealer has 17 or more, the dealer stands. The closest to a 21 count, without going over, wins; tie hands are commonly referred to as a 'push.'

Each player places their ante or first wager before any cards are dealt. The ante is typically any amount, at the player's discretion, between minimum and maximum limits set by the house rules of the gaming establishment.

Under conventional rules of play, the House rules may require that the dealer take a hit either when the dealer's initial hand is an Ace and a 6 (i.e. known as a soft 17) or, if after receiving one or more hits, the dealer's hand consists of an Ace and two or more cards that add up to a card count of 6. The Ace may thereafter be counted with a card count of 11 or 1, depending on the hits. Also, under conventional manners of play, the dealer is required to stand if his initial hand is a soft 18, soft 19 or soft 20, and the Ace is then counted with a card count of 11. If the dealer's first card, dealt face up, is an Ace, then the dealer invites the players to make an 'insurance bet'. Under 'Nevada rules' if the dealer's up card is a 10 or face card, then the dealer will check their hole card to see whether the dealer has Blackjack. In either case, if the dealer has Blackjack, then the dealer's hole card is turned over and the game then ends with either each player losing or, if the player's hand is also Blackjack, then a 'push' is declared and the rules of play require that the player's wager is returned to the player. An insured player collects on their insurance bet.

Under so-called 'London rules', the dealer does not take a hole card until after all the players have played their hands. Under 'Atlantic City' rules, the dealer does not look at their hole card if the dealer's first card is an Ace until after all the players have completed their play.

Therefore, in the conventional method of playing Blackjack, there are at least three well known alternative betting procedures. These are 'insurance', 'doubling down' and 'splitting pairs'.

After each player and the dealer receives their first two cards, if the dealer's face-up card is an Ace, each player may elect to make an "insurance" bet. The amount of the insurance bet, for each player making the election, is a maximum of one-half of the amount of his original ante. Then the dealer, without turning over his face down card, checks the face down card, and if the dealer has a Blackjack (a two card, Twenty-One count hand), he then turns over the face down card. Each player placing an insurance bet wins and is paid on a 2 to 1 basis for the insurance bet only. All players who do not also have a two card, Twenty-One count (a Blackjack), lose their original ante regardless of their insurance bet. Each player also having a two card Twenty-One count hand has his ante returned to him or loses his ante, depending on the house rules.

Another well known procedure utilized by gaming establishments is "doubling down". The initial two card, hand count total which permits a player to elect to "double down", is established by house rules. Although many casinos now allow the player to double down on any initial two card hand, the three most common double down hand counts utilized by gaming establishments are (a) nine, ten, or eleven; (b) ten or eleven; or (c) eleven only. If the player has an initial two card hand count total equal to one of the values established by the house rules, he may elect to double down. The player informs the dealer of his election to double down and places an additional wager equal to the amount of his original ante. The dealer then deals to that player one and only one additional card, and the resulting three card hand establishes the final count for that player's hand. The player's three card hand count is compared with the dealer's final hand count and the amount of the player's wager is the total of the original ante and the double down bet.

Another well known procedure utilized by gaming establishments is "splitting pairs". If the first two cards of a player's hand are a pair or are both ten count cards, that player may elect to "split" the initial two cards into two separate hands. He then elects to apply his original ante to one of the two hands and places an additional ante for the other hand. Both of the original two cards are then turned face up and the player plays each of the two hands as a separate hand in accordance with the house rules. Some gaming establishments only allow splitting if the player's first two cards are a true pair. House rules may allow a player to double down on either or both hands.

The terms standard or conventional method, standard or conventional manner, and standard or conventional rules as used in the specification and in the claims herein are intended to refer to the game of Blackjack or Twenty-One as previously described as well as any known variations of the game Blackjack or Twenty-One.

The conventional game of Twenty-One has a number of disadvantages, both from the casino's standpoint as well as the players. One such disadvantage is that the house 'edge' in the game is extremely small against players who do nothing more than play what is called 'basic strategy', a system of play which defines the best action (hit, stand, double-down, etc.) the player should take in each playing situation. More and more players are becoming familiar with 'basic strategy' with the result that the game is not as profitable as the casinos would like. In addition, since the betting action is limited, the profitability intake for the casino over a period of time is smaller than it would be if additional betting action is possible.

The conventional game of Twenty-One also has a number of disadvantages for the player. One such disadvantage is that, once the player draws their cards and exceeds a count of 21, the player has no further interest in what occurs during the remainder of the round. In other words, once the player loses, it is very frustrating for the player to sit at their table until the other players finish drawing their cards. It is even more frustrating after the player has busted if the dealer then also breaks.

Blackjack can also become somewhat boring after extended rounds of play due to the limited number of bets that can be made in the game, i.e. the insurance bet, doubling down, or splitting pairs. Indeed, these additional bets, as discussed extensively above, can only be made when certain conditions pertaining to the player's or dealer's hand exist. There is no opportunity to make these bets during each round of play; that opportunity only exists with respect to the ante or first wager each player must make to get into the game.

As mentioned briefly above, there are a number of modifications that afford the player with an opportunity to make an additional wager, such as disclosed in U.S. Pat. Nos. 5,174,579 and 5,454,570. In actuality, however, these side or secondary bets are considered to be 'sucker bets' since they are heavily in favor of the house and most players will therefore decline to make such bets.

It is accordingly an object of the present invention to make the game of Blackjack more fun for the players by introducing an additional wager that will enable a player to win a bet, and at least 'push', even if the player loses their hand by exceeding 21.

Another object is to afford the player the opportunity to make an additional wager that, in fact, favors the house without creating the perception that the bet is a sucker bet.

Still a further object is to allow the player to make an additional wager without requiring extensive training of the dealers so that the additional wager is both easily understood by both the dealers and the players and is easily managed by the dealer in determining payout.

Yet another object is to provide the player with an opportunity for making an additional wager that automatically converts into an insurance bet if the dealer's first card is an Ace.

Still another object is to allow the players to make an additional wager, at the player's option, for each round of play.

DISCLOSURE OF THE INVENTION

The present invention relates to a method of playing a standard game of Twenty-One with at least one standard deck of playing cards. The game comprises the steps of a player making a first wager to participate in the standard game of Twenty-One. The player can then make a second wager or HEDGE BET™ that the dealer's first two cards are a standing hand. The player then participates in the standard game of Twenty-One conducted according to a standard method of play modified in accordance with the above. The player wins on their second bet if the dealer's first two cards are a standing hand, irrespective of whether the player wins their first wager.

The HEDGE BET™ must be made at the same time as the first wager and before any cards are dealt in the round. The dealer then deals the cards out and the game of Twenty-One is played according to conventional rules. After all the players have made their decisions, then the dealer turns over the dealer's hole card. If the dealer has a two card standing hand, then the player wins their second wager. If the dealer has to hit, then the player loses their second wager.

Preferably but not necessarily, the standing hand does not include a soft 17 in which case the player loses the second wager and the dealer has to hit.

In accordance with another feature of this invention, if the dealer displays an Ace up on the dealer's first card then the HEDGE BET™ is off; however, the dealer converts the HEDGE BET™ to an automatic insurance bet. This creates the perception in the mind of the player that they are receiving a free insurance bet. In actuality, however, this conversion feature favors the house, while allowing the secondary wager to remain saleable to the player, by awarding the Ace with the '6', '7', '8' and '9' combinations to the house.

In accordance with another feature of this invention, the second wager preferably cannot exceed one half the amount of the first wager. The primary purpose for this rule is to make it easier for the dealer to make payouts on the bet while creating a false appearance of exclusivity in the mind of the player by creating the suggestion that the house does not really want the player to make this bet and therefore limits same to one-half the original bet.

The dealer's standing hand preferably does not include a soft 17, in which case the player loses the second wager. This feature provides more favorable odds for the house by taking away from the player the combination of an Ace with a 6 without unduly affecting the appearance of fairness of the second wager.

The present invention also relates to a game board display for playing a modified game of Twenty-One. The display comprises a display support medium having a display surface provided with a Blackjack game layout in the form of indicia establishing individual player locations for each player to place their primary wager and to receive their cards from the dealer. A first bar designated by further indicia with the identifier "INSURANCE" is also provided in which first bar a player may selectively make an insurance bet in accordance with the standard rules of Blackjack. The game board display, in accordance with the invention, features a second bar in which a player may selectively make a second wager as to whether the dealer will achieve a standing hand.

The second bar preferably includes second indicia representative of the function of the second bar. Such suggestive of the nature of the bet.

In the preferred embodiment, the first and second bars are arcuately shaped segments that are disposed adjacent each other and extend circumferentially so as to be co-extensive with at least substantially all of the individual player locations. In accordance with a unique preferred feature of the invention, the second bar is further from the players than the first bar. In this manner, if the dealer's first card is an Ace, the second wager automatically becomes an insurance bet and the second wager is physically moved closer to the player to achieve a positive psychological affect of money coming in the player's direction.

It is within the scope of this invention that the game board display is an electronic display of an electronic video gaming machine.

In accordance with yet another aspect of this invention, a method of playing a Twenty-One game and electronic gaming machine is also disclosed. The method comprises the steps of electronically recording a player placing a first wager to participate in the standard game of Twenty-One with the machine, and electronically recording the player placing a second wager that the electronic dealer's first two cards are a standing hand. A first hand comprising two cards representing the player's hand is then electronically displayed. At least one card, dealt face up, representing the first card of the dealer's hand is also electronically displayed. The player then electronically stands or receives additional cards as desired by the player in accordance with the conventional manner of play of Twenty-One. The dealer then stands or receives additional cards as part of the dealer's hand in accordance with the conventional play. The dealer's selected hand is then electronically compared to the player's selected hand in accordance with the conventional manner of play of Twenty-One. The player is awarded a predetermined amount if the player's hand beats the dealer's hand. Independently, the player is awarded a second predetermined amount if the dealer's selected initial two-card hand is a standing hand. The game according to this present invention can also be played on a home computer wherein the game is embodied in software according to the logic of the invention as set forth in this application, or may be available as shareware.

Therefore, the game according to this present invention can be played in a live game version, either in a casino or elsewhere, or an electronic video gaming machine which is programmed to display the game and provide the payouts to the player as well as the option of placing the second wager of this invention that the dealer's hand is a standing hand.

Further objects and advantages of the invention will be brought out in the following portions of the specification, wherein the detailed description is for the purpose of fully disclosing preferred embodiments of the invention without placing limitations thereon. It is intended that the claims define the scope of the invention.

BEST MODE FOR CARRYING OUT THE INVENTION

The present invention is directed to a modified version of Twenty-One wherein there are one or more players and a dealer, and play proceeds in accordance with the conventional rules and variations thereto such as described hereinabove, with the exception that each player is afforded the opportunity to make a second wager or "HEDGE BET™" (in addition to the player's ante which must be made to participate in the game) that the dealer's first two cards will be a standing hand. It is believed that this unique variation to Twenty-One will rapidly become a popular bet amongst Blackjack players since it creates a perception of advantage to the player in a variety of ways. First, it affords the player an opportunity to win at least the second wager in the event that the dealer achieves a standing hand, even if the player's hand exceeds 21 or otherwise loses to the dealer's hand, and to win both the first and second wager if the player has a winning hand. Second, for the first time in the history of Blackjack of which the Applicant is aware, the player is afforded an opportunity to 'hedge' his primary wager, by betting that the dealer will achieve a standing hand which is often perceived by players to occur at frequent intervals. Third, players are provided with a unique opportunity to bet that the dealer will achieve not just a single numerical hand count, but a wide range of two card combinations whose numerical value of 17, 18, 19, 20 or 21 will result in a standing hand. More importantly, the player's odds of winning the HEDGE BET™ can be significantly reduced, depending on the number of card decks used, in favor of the casino without creating the perception of unfair advantage by, for example, not including soft 17 as a winning hand, and/or by automatically converting the HEDGE BET™ to an insurance bet if the dealer's face card is an Ace or 10. This unique ability to 'fine tune' the odds in favor of the Casino while maintaining for the player a large range of winning hands is what makes the HEDGE BET™ as a separate wagering feature attractive to both the Casino as well as the player. Other advantages achieved with this unique wagering feature will undoubtedly occur to persons skilled in the art from a review of this specification.

Figure 1:
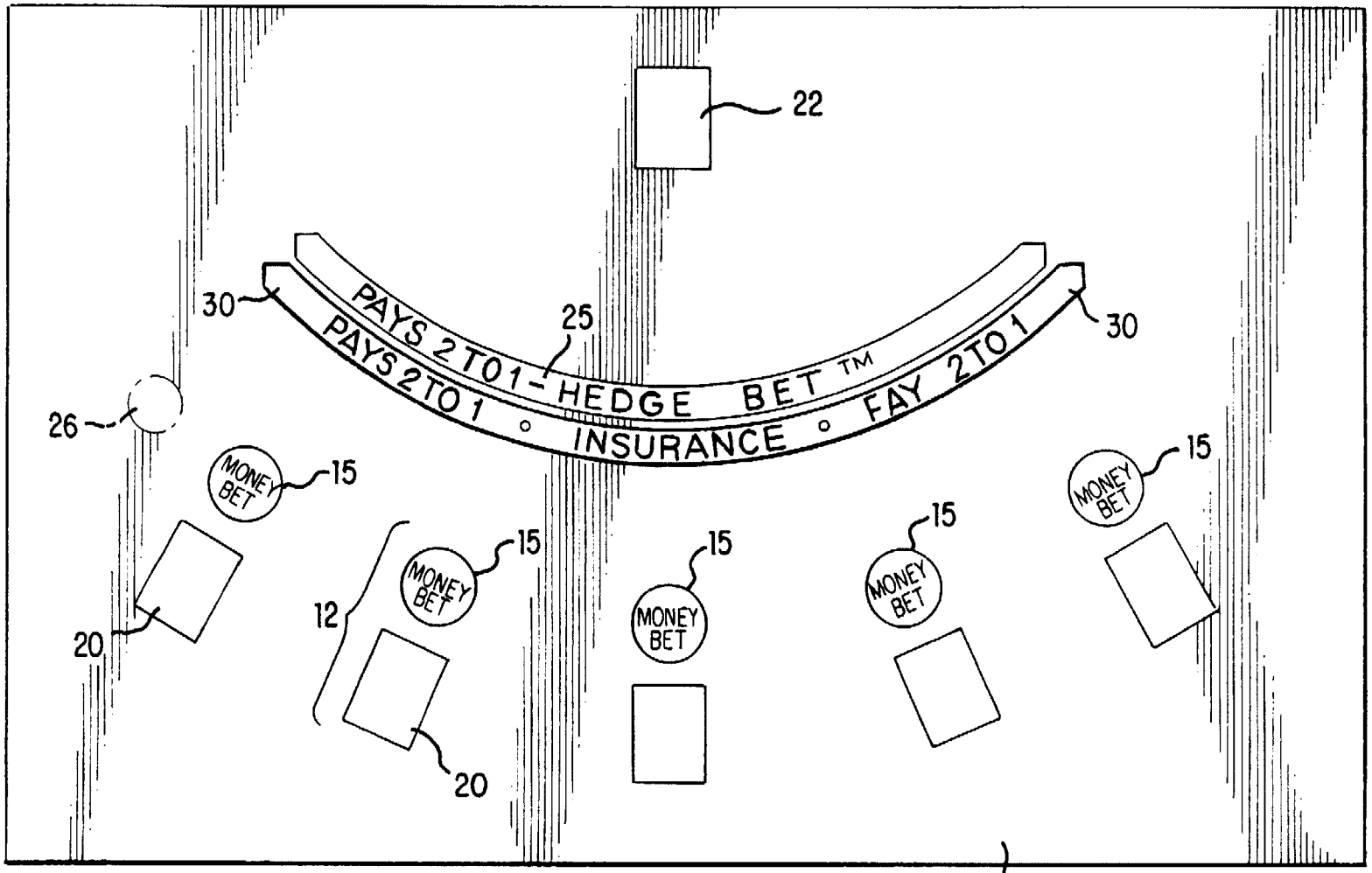
FIG. 1 is a preferred layout of a table-top, game board or electronic display that is used in connection with the modified method of playing the game Twenty-One in accordance with a preferred embodiment of the present invention.

FIG. 1 is an illustration of a preferred table top, game board or electronic display, generally designated with reference numeral 10, that can be used with the method and structure of the present invention. The game table 10 is utilized with a game layout which provides one or more individual player locations 12. Each player places his first wager or ante bet within location 15. The player's and dealer's initial hands are then dealt according to the house rules by placement of the cards in the individual player's locations 20 and the dealer's location 22. Prior to dealing the cards, and at the time that the first or primary wager 15 is made, each player has the option of making a secondary wager or HEDGE BET™, by placing within HEDGE BET™ bar 25 an amount equal to, for example, one half of the ante.

In addition, if desired, the second wager may be made by initial placement thereof on the insurance bar of a standard Twenty-One playing surface, the insurance bar thereby performing a dual function of recording insurance bets as well as second wager bets.

If the dealer's initial face up card is an Ace, the HEDGE BET™ wager 25 is automatically moved by the dealer into the Insurance bar 30. Advantageously, therefore, any player making the HEDGE BET™ under such circumstances will believe that they are making a free insurance bet due to this automatic conversion feature. Additionally, by locating the HEDGE BET™ bar 25 further from the players, as depicted in FIG. 1, this arrangement is believed to create a favorable psychological effect that enhances the player's perception of the HEDGE BET™ value as a result of the physical movement of the HEDGE BET™ onto the insurance bar 30 when the dealer's initial face up card is an Ace. However, it will be understood that the HEDGE BET™ bar 25 may be closer to the players than the insurance bar 30. In addition, the HEDGE BET™ bar 25 may be replaced with HEDGE BET™ betting spots 26 adjacent each player's main betting spot 15. A representative HEDGE BET™ betting spot 26 is identified in phantom line adjacent one player's main betting spot 15, the remaining HEDGE BET™ betting spots 26 being omitted from the drawing to avoid clutter.

After the players have otherwise made their insurance, double down and splitting elections and the additional bets have been placed in accordance with the standard rules of Blackjack, then play continues in the conventional manner. If the dealer has a Blackjack then all players lose their initial bet, except those players who also have a Blackjack. In addition, those players who have made the HEDGE BET™ will win their secondary wager as an insurance bet. Under one manner of play, players also with a Blackjack have their original ante returned. A variation may provide that a player loses in the event of a push, even if he has a Blackjack.

The dealer otherwise then proceeds to each player in turn who may elect to take any number of additional cards, unless they have made the double down election, until the player's hand count equals or exceeds 21 or the player may elect to stand at any hand count which is less than 21. Players who have elected to double down receive only one additional card. If splitting is allowed, then each player plays their split hand in accordance with the above house rules.

After all the players have taken hits as desired or have stood on their original hand, the dealer then reveals their hole card. If the dealer's initial two cards result in a standing hand, i.e. 17 or better, although under some house rules the dealer must take a hit on soft 17, then those players who have placed the HEDGE BET™ win automatically. The dealer then proceeds to either pay each player their original bet (if the player has a winning hand) and will also automatically pay each player who has placed the HEDGE BET™. If the dealer does not have a standing hand, then each player who placed the HEDGE BET™ loses their secondary wager and the dealer then continues to take additional cards until the dealer's hand breaks or equals at least 17. At that time, the dealer will pay out to each player their wins and losses based upon the hand count total of each player compared with the hand count total of the dealer unless either breaks.

As discussed above, the HEDGE BET™ preferably cannot exceed one-half the amount of the ante. The primary purpose for this rule is to make it easier for the dealer to make payouts on the bet while creating a false appearance of exclusivity in the mind of the player by creating the suggestion that the house does not really want the player to make this bet and therefore limits same to one-half the original bet.

In the preferred embodiment, the first and second bars 25, 30 are arcuately shaped segments best depicted in FIG. 1 which are disposed adjacent each other and extend circumferentially so as to be coextensive with the individual player locations 12.

Figure 2:
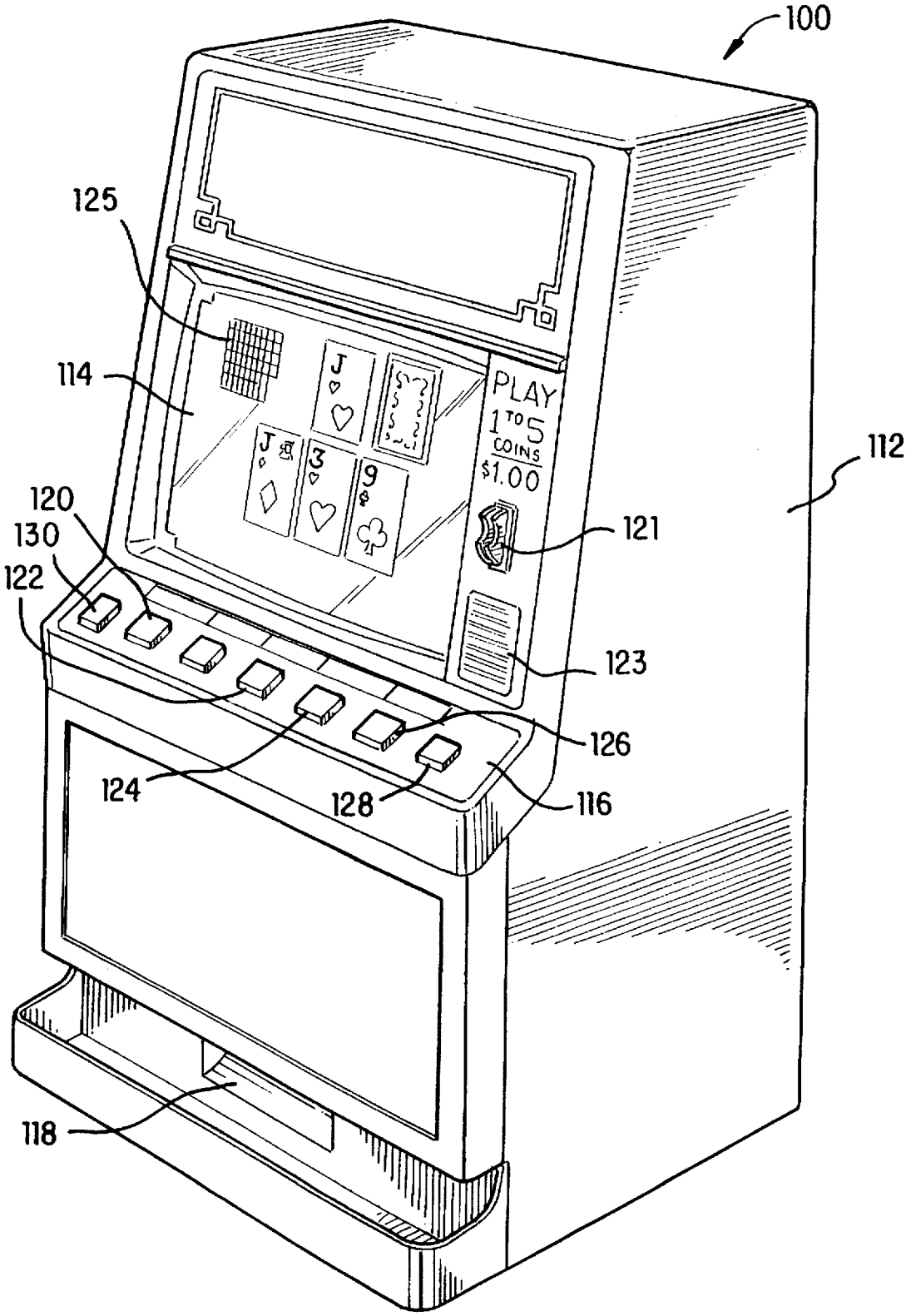
FIG. 2 is a typical configuration of an electronic video game machine within which has been incorporated the game of the present invention.

FIG. 2 is an illustration of an electronic video game machine 100 which includes a housing 112 having a front face panel including a video display screen 114, a button ledge 116 and a coin payoff trough 118. Control buttons are provided on the button ledge 116 to operate the following functions: BET 120, INSURANCE 122, SPLIT 124, HEDGE BET™ wager 126, STAND 128, and HIT/DEAL 130.

The game is activated when a player deposits coins within a coin deposit slot 121 or by other means as known in the art. Those skilled in the art will appreciate that some limit is usually placed on the initial wager. In the illustrated embodiment, an indication may be provided on the video display screen 114 as to the size of the initial bet. Also included on the front face panel of the housing 112 are game instructions 123 to instruct the player as to how to play the game and preferably written instructions 125 on the video screen 114 as to what action is required by the player at a particular time.

The use of video games having an appearance such as that depicted in FIG. 2 is quite common. According to the present invention, included within the housing 112 are appropriate electronics and software which are pre-programmed to effect the playing of the game of this invention. The particular electronic elements utilized in programming format can be readily assembled and performed by one skilled in the art in light of the description of the invention provided herein, therefore, further detailed explanation of the specific electronics and programming is not provided.

The control buttons 120–130 are intended to function in the same manner as a conventional electronic video gaming Blackjack machine as presently known in the industry, with the exception of the novel inclusion of HEDGE BET™ control button 126. The HEDGE BET™ control button 126 can only be actuated before the HIT or DEAL button 130 is depressed since the HEDGE BET™ must be placed before the cards are dealt. In the FIG. 2 illustration of gaming machine 100, it can be seen that the player's hand has already exceeded 21 (Jack-3-9) and therefore the player has lost their primary wager. However, if the player has placed the HEDGE BET™ prior to the dealer being dealt the face up card (i.e. Jack, in this case), then the player stands to collect the HEDGE BET™ if the dealer's hole card is a 7, 8, 9, 10, Ace, or another picture card. Obviously, the specific electronics and programming necessary to implement the HEDGE BET's™ control feature into gaming machine 100 can be easily performed by one skilled in the art based upon the present specification.

While the invention has been illustrated with respect to several specific embodiments thereof, these embodiments should be considered as illustrative rather than limiting in nature. Various modifications and additions may be made and will be apparent to those skilled in the art. Accordingly, the invention should not be limited by the foregoing description, but rather should be defined only in the following claims.

I claim:

1. A method of playing a standard game of Twenty-One with at least one standard deck of playing cards, comprising the steps of:

a) a player making a first wager to participate in the standard game of Twenty-One;

b) the player making a second wager that the dealer's first two cards are a standing hand according to predetermined game rules;

c) the player participating in said standard game of Twenty-One conducted according to a standard method of play; and d) the player winning on his second wager if the dealer's first two cards are a standing hand, wherein there exists a range or series of desired two card hand counts of 21 and less from which the dealer's standing hand results.

2. The method of claim 1, wherein said standing hand does not include a soft 17, in which case the player loses the second wager.

3. The method of claim 1, wherein said second wager cannot exceed one half the amount of the first wager.

4. The method of claim 1, wherein said second wager automatically becomes an insurance bet whenever the dealer's up card is an Ace.

5. The method of claim 4, wherein said second wager is made by initial placement thereof on an insurance bar of a standard Twenty-One playing surface, said insurance bar thereby performing a dual function of recording insurance bets as well as second wager bets.

6. The method of claim 1, wherein the second wager is placed by the player on a standard Twenty-One playing surface which has been modified to include a separately identified second wager bar which is separate and apart from an insurance bar.

7. The method of claim 6, comprising the further step of the dealer physically moving the second wager to the insurance bar to thereby automatically convert same to an insurance bet when the dealer's up card is an Ace.

8. The method of claim 5, wherein the second wager bar is physically further away from the player than the insurance bar so that, in the event the dealer's up card is an Ace, the dealer physically moves the second wager closer to the player by converting said second wager into an insurance bet.

9. The method of claim 1, wherein said range or series includes the dealer's standing hand having a cumulative point value of '17', '18', '19', '20' and '21'.

10. The method of claim 1, wherein the player may make the second wager only before the dealer begins to deal any of the cards to either any of the players or the dealer.

11. A method of playing a game of Twenty-One, comprising the steps of:

a) a player making a first wager to participate in the game;

b) the player making a second wager that the dealer achieves a standing hand according to predetermined game rules with the dealer's first two cards;

c) the player participating in said game of Twenty-One; and d) the player winning on the second wager if the dealer's first two cards are a standing hand, wherein there exists a range or series of desired hand counts of '21' or less from which the dealer's standing hand results.

12. The method of claim 11, wherein said second wager is made only at the time that the first wager is made.

13. A method of playing a game of Twenty-One, comprising the steps of:

a) a player making a first wager to participate in the game;

b) the player making a second wager only at the time the first wager is made that the dealer achieves a standing hand according to predetermined game rules;

c) the player participating in said game of Twenty-One; and d) the player winning on the second wager if the dealer has a standing hand, wherein there exists a range or series of desired two card hand counts of '21' and less from which the dealer's standing hand results.

14. The method of claim 13, wherein said second wager automatically becomes an insurance bet whenever the dealer's up card is an Ace.

15. A game board display for playing a modified game of Twenty-One as claimed as claim 1, comprising:

a display support medium having a display surface provided with a Blackjack game layout in the form of indicia establishing individual player locations for each player to place their primary wager and to receive their cards from the dealer, a first bar designated by further indicia with the identifier "INSURANCE" in which first bar a player may selectively make an insurance bet in accordance with the standard rules of Blackjack, and a second bar in which a player may selectively make a second wager as to whether the dealer will achieve a standing hand.

16. The game board display of claim 15, wherein the second bar includes second indicia representative of the function of the second bar.

17. The game board display of claim 16, wherein said second indicia includes the identifier "HEDGE BET™".

18. The game board display of claim 16, wherein said first and second bars are arcuately shaped segments that are disposed adjacent each other and extend circumferentially so as to be coextensive with at least substantially all of the individual player locations.

19. The game board display of claim 18, wherein the second bar is further from the players than the first bar.

20. The game board display of claim 18, wherein said game board is an electronic display of an electronic gaming machine.

21. A method of playing a Twenty-one game on an electronic gaming machine, comprising:

a) electronically recording a player placing a first wager to participate in the standard game of Twenty-One with the machine;

b) electronically recording a player placing a second wager that the electronic dealer's first two cards are a standing hand according to predetermined game rules;

c) electronically displaying a first hand comprising two cards representing the player's hand and at least one card, dealt face up, representing the first card of the dealer's hand;

d) the player electronically standing or receiving additional cards as desired by the player in accordance with the conventional manner of play of Twenty-One;

e) the dealer then standing or receiving additional cards as part of the dealer's hand in accordance with the conventional manner of play;

f) electronically comparing the dealer's hand to the player's hand in accordance with the conventional manner of play of Twenty-One; and g) awarding the player a predetermined amount if the player's hand beats the dealer's hand in accordance with the conventional manner of play of Twenty-One, and independently awarding the player the second wager if the dealer's hand is a standing hand, wherein there exists a range or series of desired two card hand counts of '21' and less from which the dealer's standing hand results.

* * * * *